US005098052A

United States Patent [19]

Beck

[11] Patent Number: 5,098,052

[45] Date of Patent: Mar. 24, 1992

[54] MAGNETIC SUPPORT TRAY FOR LADDER SHELF

[76] Inventor: Daniel L. Beck, 1010 W. Ash, Blytheville, Ark. 72315

[21] Appl. No.: 710,954

[22] Filed: Jun. 6, 1991

[51] Int. Cl.[5] ..... E06C 7/14

[52] U.S. Cl. ..... 248/238; 182/126; 182/129

[58] Field of Search ..... 182/129, 126; 248/210, 248/238

[56] References Cited

U.S. PATENT DOCUMENTS

| | | | |
|---|---|---|---|
| 2,461,825 | 2/1949 | Kowalski | 248/210 |
| 2,473,951 | 6/1949 | Hickey | 248/210 |
| 2,982,982 | 5/1961 | Swift, Sr. | 248/210 |
| 3,106,987 | 10/1963 | Lerner | 182/126 |
| 3,285,557 | 11/1966 | Reda | 248/210 |
| 3,584,702 | 6/1971 | Lang | 182/126 |
| 3,642,239 | 2/1972 | Zeller, Jr. | 248/210 |
| 4,310,134 | 1/1982 | Schopp | 182/129 |
| 4,703,833 | 11/1987 | Backman | 182/129 |

*Primary Examiner*—Reinaldo P. Machado

*Attorney, Agent, or Firm*—Fleit, Jacobson, Cohn, Price, Holman & Stern

[57] ABSTRACT

A tray member is provided including at least one pair of opposite side margin depending flanges and a center downwardly recessed portion whose undersurface is co-planar with the lower edges of the depending flanges. The downwardly recessed center portion defines an upwardly opening recess in which to receive the lower end of a paint can and the tray member includes widely spaced apart depending threaded shanks from which a clamp bar is supported through the utilization of wing nuts threadedly engaged on the shanks. The tray member may be slid into position on the horizontal shelf of a step ladder and removably clamp engaged with the shelf by tightening the wing nuts in order to clamp the shelf between the clamp bar and the underside of the tray member. In addition, the upper surface of the downwardly recessed central portion of the tray member as well as the upper surfaces of the tray member disposed about the downwardly recessed central portion of the tray member are covered with magnetized panels, whereby ferris material items placed thereon will be magnetically held in position on the tray member.

9 Claims, 1 Drawing Sheet

FIG. 1
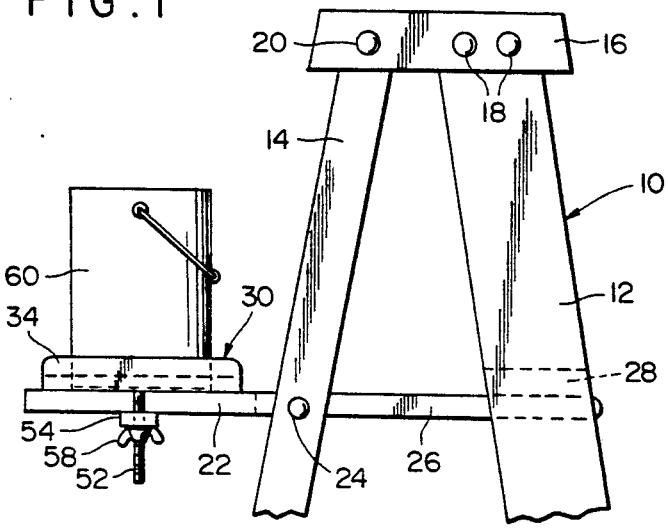
FIG. 2
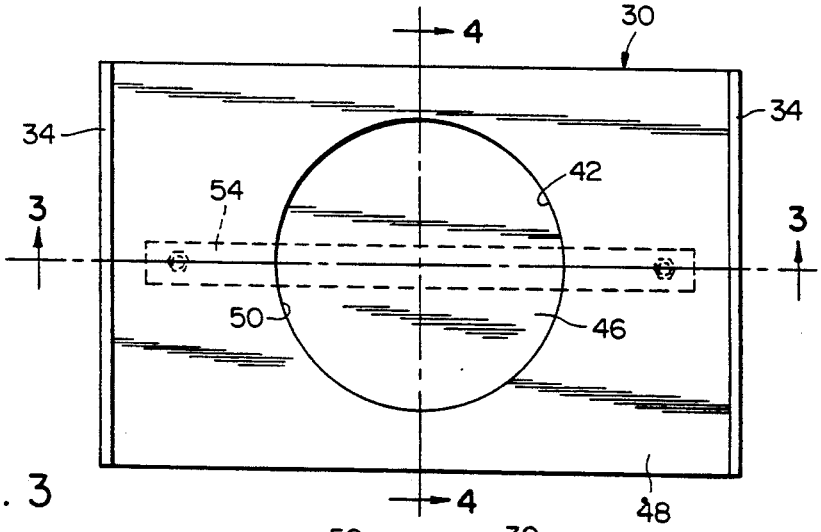
FIG. 3
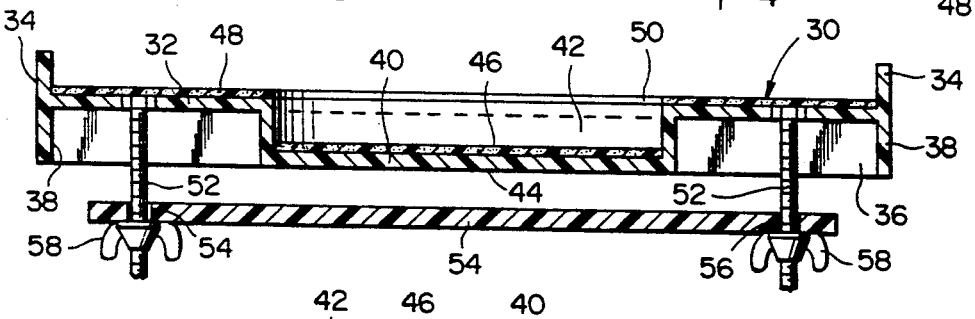
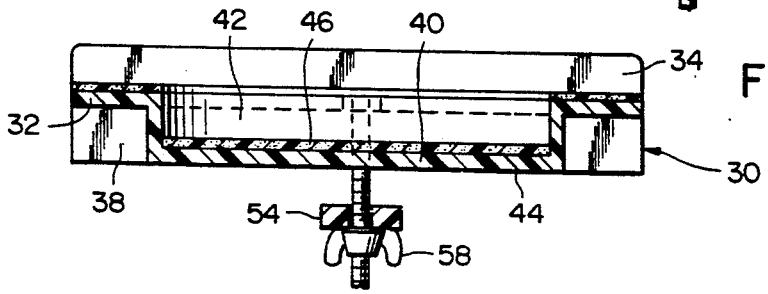
FIG. 4

MAGNETIC SUPPORT TRAY FOR LADDER SHELF

BACKGROUND OF THE INVENTION

1. Field of the Invention

This invention relates to a support tray having magnetic properties for stationarily removably supporting ferris objects therefrom and the support tray is specifically designed to be used in conjunction with the horizontally outwardly projecting shelf of a step ladder or the like.

2. Description of Related Art

Various different forms of supports for use in conjunction with ladders and designed to support various different articles heretofore have been provided. Examples of such previously known devices are disclosed in U.S. Pat. Nos. 2,982,982 and 3,642,239. However, the magnetic support tray of the instant invention includes specific structural features thereof which particularly will adapt the tray for support from a ladder shelf and also define recess means for receiving the lower end of a paint container therein, which combination of features are not disclosed by the above noted prior art.

SUMMARY OF THE INVENTION

The magnetic support tray of the instant invention is constructed of plastic and may be readily manufactured by molding processes so as to be produced at a very low cost. Further, the support tray is provided with magnetic properties through the utilization of magnetized rubber panels secured over at least some of the upper surface portions of the support tray and the support tray includes one pair of opposite side depending flanges which terminate downwardly in a horizontal, plane also containing the bottom surface of a downwardly depressed central portion of the tray defining an upwardly opening recess in which to receive the lower end of a paint can. When the support tray is supported from a ladder shelf, the lower marginal edges of the depending flanges and the undersurface of the downwardly depressed central portion rest upon the upper surface of the ladder shelf.

In addition, the tray is equipped with structure whereby it may be removably clamped engaged with an associated ladder shelf.

The main object of this invention is to provide a support tray for removable support from a ladder shelf and with the tray having magnetic properties whereby various ferris material objects may be removably stationarily supported from the tray against accidental dislodgement therefrom.

Another object of this invention is to provide a support tray in accordance with the preceding object and constructed in a manner whereby the tray may be readily removably supported from an associated ladder shelf.

Still another object of this invention is to provide a magnetic support tray including structural features thereof which serve not only to guard articles supported on the tray from being laterally displaced therefrom, but which also serve to reinforce the tray and provide improved mounting means for removably mounting the support tray from a ladder shelf.

A further object of this invention is to provide a tray which may be economically manufactured from nonferris materials and yet rendered magnetic for removable magnetic support of ferris objects therefrom.

A final object of this invention to be specifically enumerated herein is to provide a magnetic support tray in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING

FIG. 1 is a side elevational view of the upper end portion of a conventional form of step ladder with the pivoted shelf of the step ladder shown in its operative horizontal position and with the support tray of the instant invention removably supported from the shelf and in use supporting a paint can therefrom;

FIG. 2 is an enlarged top plan view of the magnetic support tray;

FIG. 3 is a further enlarged sectional view taken substantially upon the plane indicated by the section line 3—3 of FIG. 2; and FIG. 4 is another further enlarged vertical sectional view taken substantially upon the plane indicated by the section line 4—4 of FIG. 2.

DESCRIPTION OF THE PREFERRED EMBODIMENTS

Referring now more specifically to the drawings the numeral 10 generally designates a conventional form of step ladder including a main tread equipped section 12 and a prop section 14, the upper end of the prop section 14 being pivotally mounted from a top plate 16 secured to the upper end of the section 12 through the utilization of fasteners 18. The prop section 14 is pivotally mounted from the top plate 16 by pivot fasteners 20 and a planar shelf 22 is pivotally supported from the prop section 14 as at 24 and includes integral opposite side arms 26 engagable beneath the uppermost tread 28 of the section 12 in order to brace the shelf 22 in a horizontal position, the foregoing comprising a description of a conventional step ladder.

The magnetic tray member of the instant invention is referred to in general by the reference numeral 30 and includes a horizontal panel member 32 constructed of plastic. The panel member 32 is elongated and includes opposite end upstanding flanges 34 disposed substantially normal to the "X" axis of the panel member 32 extending along the section line 3—3 of FIG. 2 and opposite side depending flanges 36 disposed normal to the "Y" axis of the panel member 32 extending along the section line 4—4 of FIG. 2. In addition, the panel member 32 also includes depending opposite end flanges 38 vertically registered with the flanges 40. The flanges 34, 36 and 38 are formed integrally with the panel member 32.

The central area of the panel member 32 includes a downwardly depressed central portion 40 defining an upwardly opening recess 42 which is circular in plan shape and the undersurface 44 of the portion 40 is coplanar with the lower edges of the flanges 36 and 38. A circular disc 46 of magnetized rubber sheeting is secured over the portion 44 within in the recess 42 and a rectangular panel 48 of magnetized rubber sheeting is secured over the upper surface of the panel member 32 inwardly of the flanges 34 and includes a central opening 50 therein registered with and of the same size as the recess 42.

Opposite end portions of the panel member 32 disposed along the "X" axis extending along the section line 3-3 of FIG. 2 include downwardly projecting threaded studs which project considerably below the lower marginal edges of the flanges 36 and 38 and a clamp bar extends between the studs 52 and is equipped with opposite end bores 56 through which the studs 52 are slidingly received, threaded wing nuts 58 being threaded on the lower end portions of the studs 52 below the clamp bar 54.

In order to install the tray 30 upon the shelf 22, the wing nuts 58 are loosened sufficiently to drop the clamp bar 54 below the undersurface 44 a greater distance than the vertical thickness of the shelf 22. Then, inasmuch as the threaded shanks 52 are spaced apart a greater distance than the width of the shelf 22, the tray 30 is slipped into position over the shelf 22 from the left side thereof illustrated in FIG. 1 to the position illustrated in FIG. 1. Thereafter, the wing nuts 58 are tightened so as to draw the clamp bar 54 upwardly into engagement with the underside of the shelf 22. The tray 30 has the undersurface 44 thereof and the lower edges of the flanges 36 and 38 engaged with the upper surface of the shelf 22 and the latter is clamped between the tray 30 and the clamp bar 54.

Thereafter, a ferris container such as the paint can 60 may have the lower end thereof received within the recess 42 and magnetically attracted to the circular disc 46 which is secured, in any convenient manner, to the downwardly offset portion 40. In addition, other metallic (ferris) tools such as paint scrapers, screwdrivers and other tools may be placed upon the panel 48 about the container 60 with such tools magnetically held in position, the panel 48 also being secured to the panel member 32 in any convenient manner.

Even though the recess 42 itself would tend to prevent the container 60 from being knocked from the tray 30, the magnetic attraction between the disc 46 and the bottom of the container 60 further reduces the possibility of upset of the container 60. In addition, any tools supported from the panel 48 are less likely to be knocked from the tray 36 by the magnetic attraction between such tools and the panel 48.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a ladder of the type including a horizontally outwardly projecting shelf defining upwardly facing support surface means, a generally planar magnetic tray member supported from said shelf for magnetic securement of ferris material items in position on said tray member, said tray member including first and second pairs of remote marginal portions intersecting "X" and "Y" axes of said tray member disposed in the plane of said tray member and normal to each other, at least one pair of said marginal portions including depending marginal flanges extending therealong, said tray member including a downwardly offset central portion defining an upwardly opening central recess and including an undersurface disposed in a plane containing the lower extremities of said marginal flanges, said tray member being supported from said shelf with said undersurface and lower extremities engaged with said support surface means and with a first pair of said marginal portions projecting outwardly beyond corresponding marginal portions of said shelf, a clamp bar disposed immediately beneath said shelf and extending between and outwardly beyond said corresponding marginal portions, and adjustable effective length elongated fastener means extending between said first pair of marginal portions and the portions of said clamp bar extending outwardly of said corresponding marginal portions with said shelf adjustably removably clamped between said clamp bar and tray member.

2. The ladder and tray member combination of claim 1 wherein said tray member is constructed of plastic.

3. The ladder and tray member combination of claim 1 wherein the other pair of marginal portions include upwardly projecting flanges extending therealong.

4. The ladder and tray member combination of claim 3 wherein said other pair of marginal portions also include depending flanges extending therealong including lower extremities disposed in said plane.

5. The ladder and tray member combination of claim 1 wherein said downwardly offset central portion of said tray member includes a magnetized panel disposed thereover and secured thereto, whereby a ferris material article downwardly recessed in said upwardly opening recess is magnetically secured therein.

6. The ladder and tray member combination of claim 5 wherein the portions of said tray member disposed about said central recess include a magnetized panel disposed thereover and secured thereto.

7. The ladder and tray member combination of claim 6 wherein said tray member is constructed of plastic.

8. The ladder and tray member combination of claim 7 wherein the other pair of marginal portions include upwardly projecting flanges extending therealong.

9. The ladder and tray member combination of claim 8 wherein said other pair of marginal portions also include depending flanges extending therealong including lower extremities disposed in said plane.

* * * * *